US005366102A

United States Patent [19]

Bergner et al.

[11] Patent Number: 5,366,102

[45] Date of Patent: Nov. 22, 1994

[54] PLASTIC CONTAINER PACK WITH A PAPERBOARD JACKET

[75] Inventors: Rainer Bergner, Duesseldorf; Hubert Droessler, Erkrath; Siegfried Konkel, Duesseldorf; Volker Weiss, Langenfeld; Paul-Otto Weltgen, Hilden, all of Germany

[73] Assignee: Henkel Kommanditgesellschaft auf Aktien, Duesseldorf, Germany

[21] Appl. No.: 119,175

[22] PCT Filed: Mar. 13, 1992

[86] PCT No.: PCT/EP92/00561

§ 371 Date: Sep. 22, 1993

§ 102(e) Date: Sep. 22, 1993

[87] PCT Pub. No.: WO92/16420

PCT Pub. Date: Oct. 1, 1992

[30] Foreign Application Priority Data

Mar. 22, 1991 [DE] Germany ..... 4109425

[51] Int. Cl.[5] ..... B65D 1/42; B65D 1/48

[52] U.S. Cl. ..... 215/100 R; 206/459.5; 220/737; 220/903

[58] Field of Search ..... 40/306, 310; 206/459.5; 220/408, 410, 306, 737, 903; 215/100 R

[56] References Cited

U.S. PATENT DOCUMENTS

| | | | |
|---|---|---|---|
| 2,093,985 | 9/1937 | Stansbury | 40/306 |
| 2,228,942 | 1/1941 | Balton | 229/1.5 H |
| 2,681,526 | 6/1954 | Barney | 220/903 |
| 2,936,068 | 5/1960 | Munkachy | 220/737 |
| 3,160,326 | 12/1964 | Sturdevant et al. | 222/183 |
| 3,567,104 | 3/1971 | Arsianian et al. | 229/14 |
| 3,851,792 | 12/1974 | Ankney | 206/459.5 |
| 4,026,459 | 5/1977 | Blanchard | 220/306 |
| 4,181,765 | 1/1980 | Harmony | 220/903 |
| 4,921,117 | 5/1990 | Mucciarone | 220/737 |
| 5,279,440 | 1/1994 | Fougeres et al. | 220/410 |

FOREIGN PATENT DOCUMENTS

| | | | |
|---|---|---|---|
| 2065015 | 1/1991 | Canada . | |
| 0406625 | 1/1991 | European Pat. Off. . | |
| 1347102 | 11/1963 | France | 40/306 |
| 0193757 | 2/1907 | Germany . | |
| 3921258 | 1/1991 | Germany . | |

*Primary Examiner*—Gary E. Elkins
*Attorney, Agent, or Firm*—Ernest G. Szoke; Wayne C. Jaeschke; Kenneth Watov

[57] ABSTRACT

A plastic container package for bulk materials, such as liquids or pourable fine granules or the like, is surrounded on the outside by a close-fitting cardboard or paper jacket. The container has, at least in regions, an upper stopping edge for the cardboard jacket. To fit the container with a printable and easily removable streamer, the plastic container includes catch ramps in the form of stopping shoulders protruding from a transition region between a bottom face and associated side faces. In the position of use, the cardboard jacket is designed as a closed streamer which is fixed between the stopping shoulders by pushing it over the catch ramps.

18 Claims, 3 Drawing Sheets

PLASTIC CONTAINER PACK WITH A PAPERBOARD JACKET

BACKGROUND

1. Field of the Invention

This invention relates to a plastic container pack for pourable products, such as liquids or free-flowing fine granules or the like, the plastic container accommodating the product to be packed being externally surrounded by a close-fitting sleeve or jacket of paperboard or paper and at least locally comprising an upper retaining edge for the paperboard jacket.

2. Discussion of Related Art

There are many known packs for pourable products, such as liquids, which consist of two components, namely an inner plastic container—for example a plastic bottle—accommodating the liquid and an outer paperboard jacket which has various uses, for example as a printing surface or the like.

One pack of interest is described, for example, in Applicants' DE 39 21 258-A1. By means of this pack, it is possible to avoid carrying elements on the plastic container itself. U.S. Pat. No. 3,567,104 also describes a two-piece pack in which a large part of the plastic container itself is unable to stand on its own so that the jacket has to perform a standing function. U.S. Pat. No. 3,160,326 refers to standing and carrying-handle functions in a container of interest as part of a two-component pack, the paperboard completely surrounding the inner container. German patent, DE 193 757, discloses a vessel with a protective housing, the vessel being a bottle or jar and the protective housing consisting, for example, of pressed papier mâché. Both vessel wall elements are said to be fixedly interconnected.

Conversely, it is also known that vessels can be provided with sleeves acting as printing surfaces, the sleeves themselves being made of a stretchable plastic and being placed around the product to be labeled in the form of a sleeve.

To enable two-component packs consisting of plastic on the one hand and paper or paperboard on the other hand to be recycled, efforts have been made to simplify the separation of the two components as far as possible. One way of doing this is described in Applicants' above-cited DE-OS 39 21 258.

The problem addressed by the present invention is to enable a plastic container to be readily equipped with a printable and easily removable paperboard jacket. According to the invention, the solution to this problem is characterized in that, in the transitional zone between its base and side walls, the plastic container is provided with detent ramps forming retaining shoulders and, in the in-use position, the paperboard jacket forms an encircling sleeve which is held in position between the retaining shoulders by being pushed over the detent ramps.

This method of fixing the plastic jacket or the paper or paperboard sleeve means that the sleeve does not have to be glued to the container itself, but instead is directly fixed via the physical configuration of the container. After the sleeve has been pushed over the detent ramps to bear against the upper retaining shoulders, it is held in position on the surface of the plastic container in such a way that it cannot be lost. In the case of round plastic containers in particular, it does not matter whether the sleeve turns relative to the plastic container on the surface thereof.

It is obvious that the inclinations of the ramps may differ according to the stability of the plastic container to be jacketed. Regardless, they must be made in such a way that the sleeve is not destroyed when it is pushed over the ramps. In addition, thermoplastic containers are sufficiently resilient to ensure that the sleeve can be pushed over the ramps without difficulty.

SUMMARY OF THE INVENTION

One particular embodiment of the invention is characterized in that the plastic container is non-circular, i.e. substantially square or rectangular in cross-section, and in that the detent ramps are provided at a distance from the corners of the container on flat surface regions thereof.

No detent ramps are provided at the bottom corners of the container for making the paperboard sleeve easier to push into position.

To acquire a certain elasticity, the paper or paperboard sleeve may be provided with stamped lines and/or grooves in areas where it surrounds the corners in its in-use position.

In another embodiment of the invention, the bottom of the container is tapered or rounded and the detent ramps are molded on in this conical zone, this particular configuration facilitating the important first part of the process by which the paper or paperboard sleeve is pushed over the detent ramps.

Another embodiment of the invention includes detent ramps provided with nose-like projections or protuberances which project slightly beyond the lower edge of the paperboard sleeve in its in-use position. A configuration such as this can be useful for various reasons, for example when, on a plastic container which allows the sleeve to turn, parts of the plastic container are intended to be made visible, for example through openings formed in the sleeve, or to be covered by turning the sleeve. For example, part of the plastic container may be made transparent so that its contents can be seen, This transparent zone may then be revealed through a window in the sleeve or may be covered by turning the sleeve, so that advertizing effects, for example, or the like can be obtained.

Another embodiment of the invention includes detent ramps formed from a plurality of teeth arranged in the form of a comb.

In an alternative embodiment of the invention, individual, inwardly formed indentations are provided in a portion of the lateral surface covered by the sleeve in the region of the upper retaining edge of the container, the sleeve comprising flaps on its back surface which correspond with these indentations.

This alternative embodiment provides for particularly firm retention of the sleeve on the plastic container, and prevents the sleeve from shifting or turning on the outer surface of the container (which may be desirable in individual cases).

In a variant of the alternative embodiment, the detent ramps may be formed by the inwardly directed lower margins of the indentations. This configuration enables the detent zones provided near the bottom of the container to be dispensed with if necessary. Accordingly, in addition to the sleeve being positioned close to the bottom of the container, it may even be taken beyond the bottom of the container to form a standing edge should this be required. In general, however, it may be assumed that the sleeve ends just above the bottom of the container, thus making the container appear completely enclosed.

A general advantage of the solution provided by the invention in its various embodiments is that the sleeves generally cannot be removed intact from the plastic container, i.e. there is no danger of the contents of the container being incorrectly identified by the wrong sleeves.

To facilitate removal of the sleeves, part of an adhesive flap of the sleeve is left free of adhesive at its outer edge to form a tear-off corner. The user is thus presented with a handling flap which he or she grips and tears towards the adhesive flap of the sleeve, thus separating the sleeve from the container by tearing.

BRIEF DESCRIPTION OF THE DRAWINGS

Other features, details and advantages of the invention will become apparent from the following description in conjunction with the accompanying drawings in which like items are identified by the same reference designation, wherein.

DETAILED DESCRIPTION OF THE INVENTION

Figure 1:
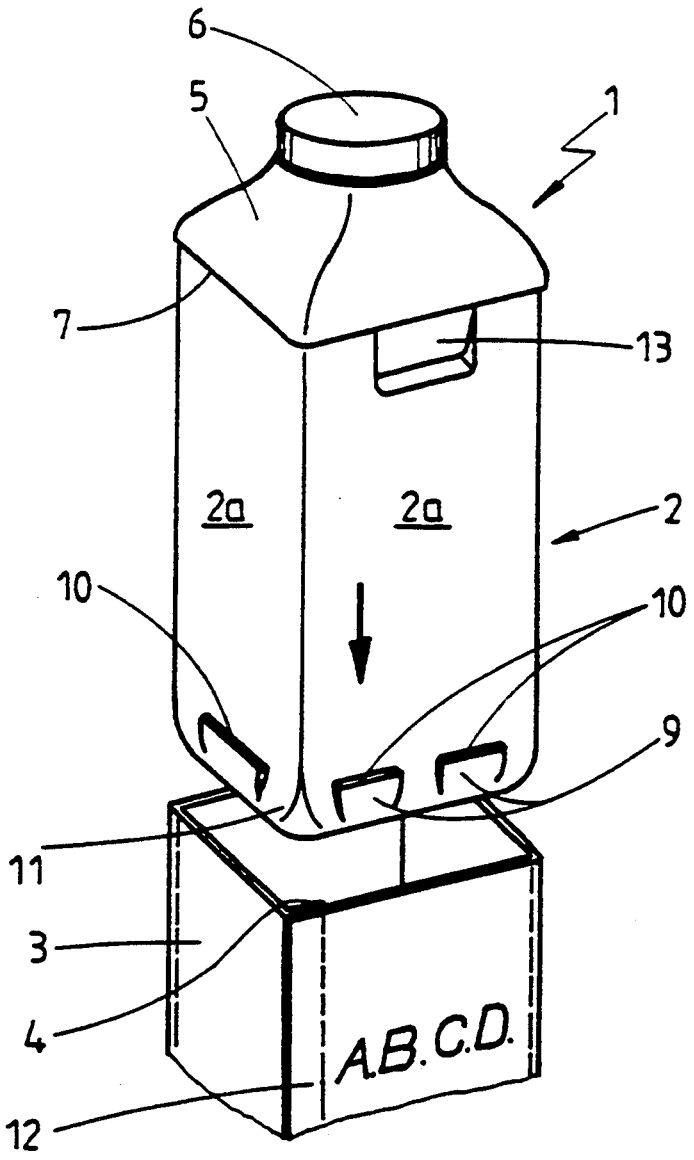
FIG. 1 shows a plastic container above a paperboard sleeve before the two are fitted together.
Figure 2:
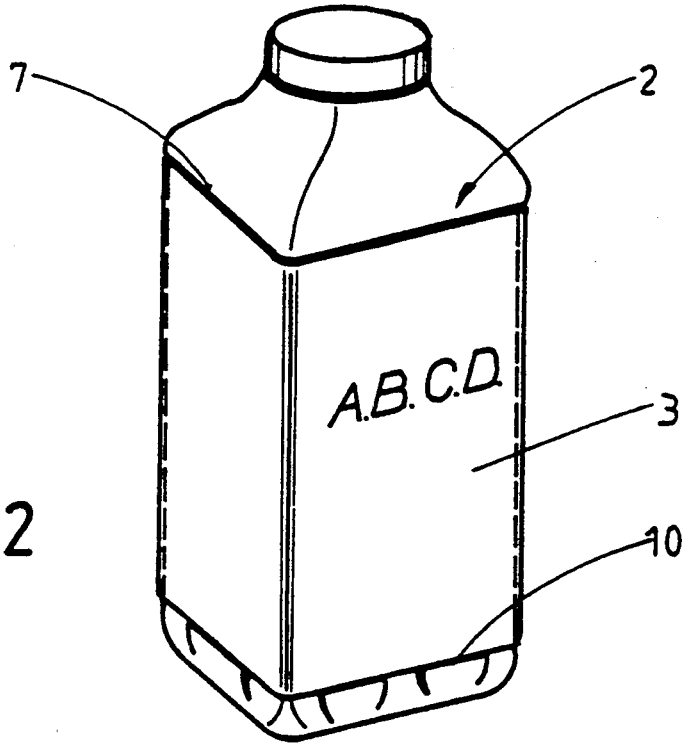
FIG. 2 shows the plastic container with the sleeve pushed into position.

Referring first to FIGS. 1 and 2, the plastic container pack globally denoted by the reference 1 is formed by a plastic container 2 and a paperboard jacket 3 in the form of a sleeve open at both ends. The adhesive flap is shown in FIG. 1 where it is denoted by the reference 4.

In the transitional zone between side walls denoted by the reference 2*a* and the top 5 of the container with a pouring opening 6, the plastic container 2 comprises an encircling retaining shoulder 7. Detent ramps 9 with retaining shoulders 10 directed towards the side walls 2*a* are provided in the transitional zone between the bottom of the container denoted by the reference 8 in FIGS. 3 and 4 and the side walls 2*a*. The distance between the retaining shoulders 7 and 10 is slightly greater than the overall height of the sleeve 3, so that, after it has been pushed into position between the retaining shoulders 7 and 10, the sleeve 3 is captively held on container 2, as can be seen from FIG. 2.

Note that although the upper retaining shoulder 7 is shown as encircling container 2, it can alternatively designed similarly to the retaining shoulders 10.

In the example shown in FIGS. 1 and 2, the detent ramps 9 are not formed at the corners of the plastic container 2 denoted by the reference 11 to enable the sleeve to be pushed more easily into position.

Figure 3:
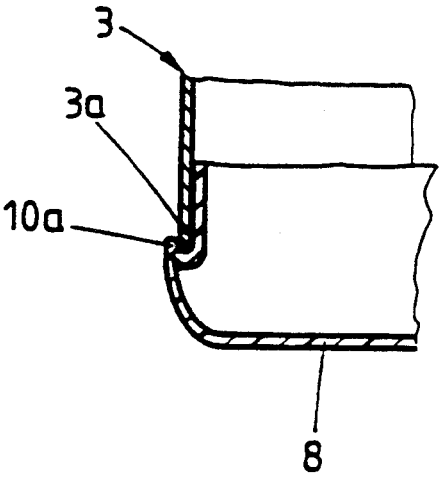
FIG. 3 is a section through the bottom of a plastic container with a sleeve according to one embodiment of the invention.

According to FIG. 3, the retaining shoulders denoted by the reference 10*a* may also be nose-like or hook-like in shape to enable them to grip the lower free end 3*a* of the sleeve 3. The bottom of container 2 is denoted by reference 8.

Figure 4:
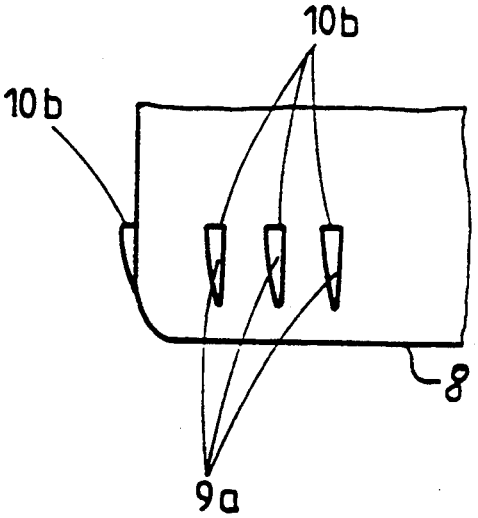
FIG. 4 is a plan view of the outer region of the bottom of a plastic container in a variant of the invention.

In FIG. 4, the detent ramps are formed by teeth arranged in the manner of a comb, the detent ramps being denoted by the reference 9*a* and the short retaining shoulders being denoted by the reference 10*b*.

The chain lines in FIGS. 1 and 2 indicate the possibility of aligning the sleeve 3 in the in-use position of the pack 1 via regions with stamped lines or grooves 12 at the corners 11 which enable the sleeve 3 to be stretched to a certain extent during fitting and, at the same time, ensure that the sleeve contracts to the same extent so that it is firmly positioned on the surface of the container 2.

Figure 5:
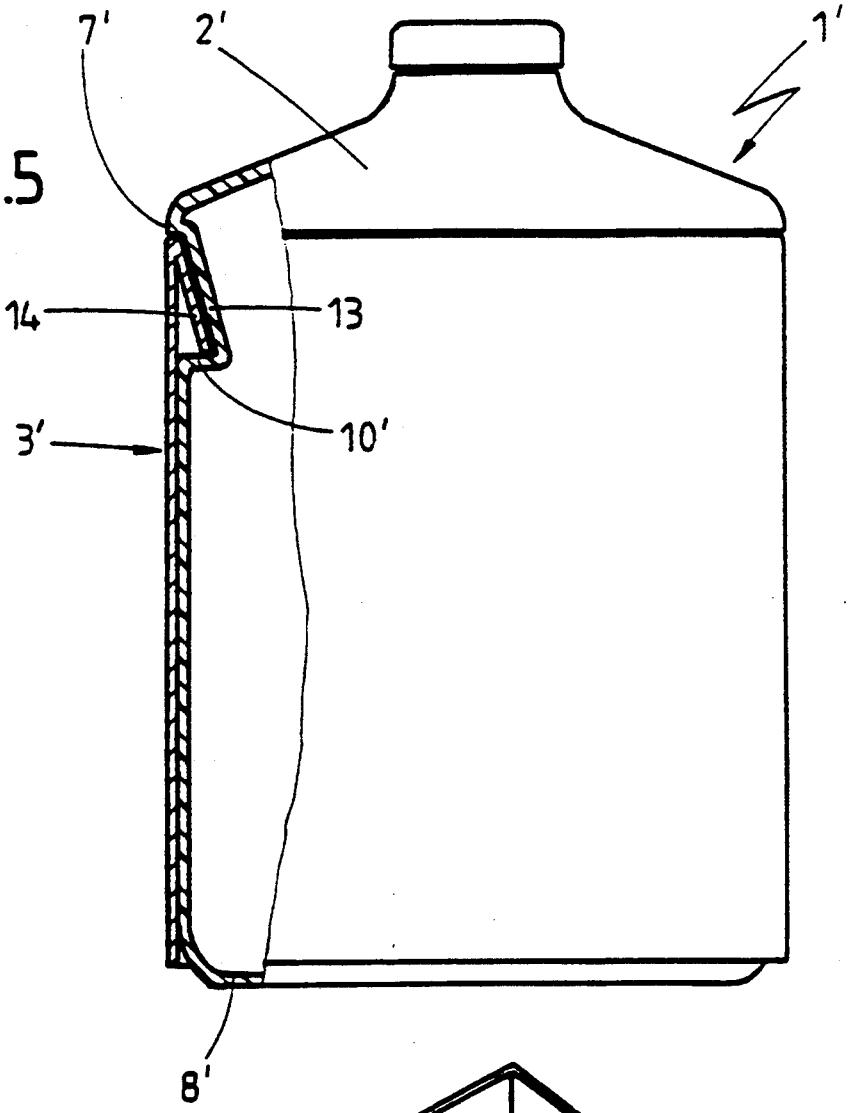
FIG. 5 is a side elevation partial sectional view of a modified embodiment of the plastic container pack according to the invention.
Figure 6:
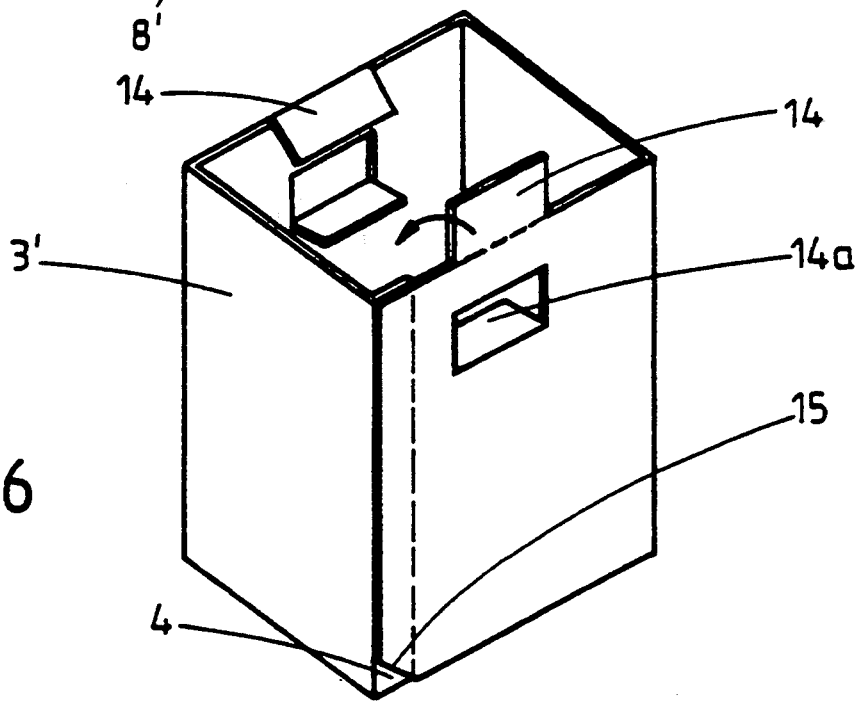
FIG. 6 is a simplified pictorial illustration of the head part of a paperboard sleeve for use in the plastic container shown in FIG. 5.

Variants of the invention are illustrated in FIGS. 5 and 6. The plastic container pack denoted by the reference 1' in FIGS. 5 and 6 is distinguished by the fact that inwardly formed indentations 13 are provided in the plastic container 2' beneath the retaining shoulder 7', as also shown in FIG. 1. To ensure that sleeve 3' can again be firmly positioned in such a way that it is held captive on container 2', the sleeve 3' comprises folded flaps 14 at its upper edge and/or elsewhere. In FIG. 6, the flaps are denoted by the reference 14*a* and 14. They are folded over inwards and, after passing over the indentation 13, spring inwards through the elasticity of the paperboard as illustrated in the top left-hand corner of FIG. 5.

As shown in FIG. 5, the indentations 13 are designed in such a way that, at their lower edge, they form retaining shoulders 10' so that no detent ramps with retaining shoulders have to be provided at the bottom 8' of the container 2.

As can also be seen from the bottom left-hand corner of FIG. 5, the sleeve 3' can extend down to the bottom of the container 2, thereby creating the visual impression that the pack is fully enclosed.

FIG. 6 also shows that a small lower part of the adhesive flap 4 is left free from adhesive to form a tear-off corner which is denoted by the reference 15.

The described embodiments of the invention may also be modified in many respects without departing from the basic concept. In particular, the invention is not confined to a particular cross-section of the plastic container 2. As illustrated, the container may be square or rectangular in cross-section. It may also be round. Also, its cross-section may even assume different curvatures.

Such other embodiments and modifications, and others that may occur to those of skill in the art, are meant to be covered by the spirit and scope of the appended claims.

What is claimed is:

1. A plastic container pack including a plastic container for storing a pourable product, said plastic container including a bottom, side walls, and a top portion, said pack further including a close fitting jacket, wherein the improvement comprises:

an upper retaining edge about the top portion of said plastic container protruding away from the associated side walls of said container;

detent ramps forming retaining shoulders formed in a lower portion of said plastic container;

said jacket being installed on said plastic container by pushing said jacket onto said plastic container from a base, and pushing the jacket over said detent ramps, whereby said jacket encircles said container and is held captively thereon between said upper retaining edge and said retaining shoulders of said detent ramps;

a plurality of individual, inwardly formed indentations in the side walls of said plastic container proximate said upper retaining edge in areas underlying said jacket when installed on said plastic container; and said jacket including a plurality of inwardly directed flaps located for permitting said flaps to be pushed into an associated one of said indentations, respectively, of said plastic container, for locking said jacket onto said plastic container.

2. The plastic container pack of claim 1, wherein said plastic container is non-circular in cross-section, and includes a plurality of corners, wherein said detent ramps are formed a distance from the corners of said container on flat surfaces thereof.

3. The plastic container pack of claim 2, wherein said jacket includes stamped lines and/or grooves in areas where it surrounds the corners of said container, when installed thereon.

4. The plastic container pack of claim 1, wherein the bottom of said container is tapered or rounded, for forming a conical zone thereabout, and said detent ramps are molded within the conical zone.

5. The plastic container pack of claim 2, wherein the bottom of said container is tapered or rounded, for forming a conical zone thereabout, and said detent ramps are molded within the conical zone.

6. The plastic container pack of claim 1, wherein said detent ramps are configured to include nose-like projections or protuberances projecting slightly beyond a lower edge of said jacket when installed on said container.

7. The plastic container pack of claim 1, wherein said detent ramps are formed from a plurality of teeth arranged in juxtaposition, a topmost portion of each of said teeth providing a said retaining shoulder, and each of said teeth having downwardly converging side portions relative to said base.

8. The plastic container pads of claim 1, wherein said retaining shoulders are formed by inwardly directed lower margins of said indentations, respectively.

9. The plastic container pack of claim 1, wherein said jacket is formed from a single sheet of material, and includes overlapping free ends, one of which underlies the other, the underlying end being coated with adhesive to serve as an adhesive flap for bonding to the overlying free end, whereby one corner of said overlapping free end forms a tear-off corner and the associated underlying end portion is left free of adhesive.

10. The plastic container pack of claim 2, wherein said detent ramps are configured to include nose-like projections or protuberances projecting slightly beyond a lower edge of said jacket when installed on said container.

11. The plastic container pack of claim 4, wherein said detent ramps are configured to include nose-like projections or protuberances projecting slightly beyond a lower edge of said jacket when installed on said container.

12. The plastic container pack of claim 2, wherein said detent ramps are formed from a plurality of teeth arranged in juxtaposition, a topmost portion of each of said teeth providing a said retaining shoulder, and each of said teeth having downwardly converging side portions relative to said base.

13. The plastic container pack of claim 4, wherein said detent ramps are formed from a plurality of teeth arranged in juxtaposition, a topmost portion of each of said teeth providing a said retaining shoulder, and each of said teeth having downwardly converging side portions relative to said base.

14. The plastic container pack of claim 5, wherein said detent ramps are formed from a plurality of teeth arranged in juxtaposition, a topmost portion of each of said teeth providing a said retaining shoulder, and each of said teeth having downwardly converging side portions relative to said base.

15. The plastic container pack of claim 6, wherein said detent ramps are formed from a plurality of teeth arranged in juxtaposition, a topmost portion of each of said teeth providing a said retaining shoulder, and each of said teeth having downwardly converging side portions relative to said base.

16. The plastic container pack of claim 2, wherein said jacket is formed from a single sheet of material, and includes overlapping free ends, one of which underlies the other, the underlying end being coated with adhesive to serve as an adhesive flap for bonding to the overlying free end, whereby one corner of said overlapping free end forms a tear-off corner and the associated underlying end portion is left free of adhesive.

17. The plastic container pack of claim 4, wherein said jacket is formed from a single sheet of material, and includes overlapping free ends, one of which underlies the other, the underlying end being coated with adhesive to serve as an adhesive flap for bonding to the overlying free end, whereby one corner of said overlapping free end forms a tear-off corner and the associated underlying end portion is left free of adhesive.

18. A plastic container pack including a plastic container for storing a pourable product, said plastic container including a bottom, side walls, and a top portion, said pack further including a close fitting jacket, wherein the improvement comprises:

an upper retaining edge about the top portion of said plastic container protruding away from the associated side walls of said container;

detent ramps forming retaining shoulders formed in a lower portion of said plastic container;

said jacket being installed on said plastic container by pushing said jacket onto said plastic container from a base, and pushing the jacket over said detent ramps, whereby said jacket encircles said container and is held captively thereon between said upper retaining edge and said retaining shoulders of said detent ramps;

said plastic container being non-circular in cross-section, and including a plurality of corners, wherein said detent ramps are formed by a plurality of teeth arranged in juxtaposition a distance from the corners of said container on flat surfaces thereof; and said jacket being formed from a single sheet of material, and including overlapping free ends, one of which underlies the other, the underlying end being coated with adhesive to serve as an adhesive flap for bonding to the overlying free end, whereby one corner of said overlapping free end forms a tear-off corner and the associated underlying end portion is left free of adhesive.

* * * * *